US008997844B2

(12) United States Patent
Riondet et al.

(10) Patent No.: US 8,997,844 B2
(45) Date of Patent: Apr. 7, 2015

(54) REINFORCED COLLECTOR FOR THE COLLECTING BOX OF A HEAT EXCHANGER AND COLLECTING BOX COMPRISING ONE SUCH COLLECTOR

(75) Inventors: Christian Riondet, Bourgogne (FR); Jean-Marc Lesueur, Reims (FR)

(73) Assignee: Valeo Systemes Themiques, Les Mesnil Saint Denis, Cedex (FR)

( * ) Notice: Subject to any disclaimer, the term of this patent is extended or adjusted under 35 U.S.C. 154(b) by 1190 days.

(21) Appl. No.: 12/092,508

(22) PCT Filed: Oct. 31, 2006

(86) PCT No.: PCT/EP2006/067960

§ 371 (c)(1), (2), (4) Date: Sep. 18, 2008

(87) PCT Pub. No.: WO2007/051790

PCT Pub. Date: May 10, 2007

(65) Prior Publication Data

US 2009/0145590 A1 Jun. 11, 2009

(30) Foreign Application Priority Data

Nov. 2, 2005 (FR) ..... 05 11181

(51) Int. Cl.

| | |
|---|---|
| ***F28F 9/02*** | (2006.01) |
| ***F28D 1/06*** | (2006.01) |
| ***F28D 1/02*** | (2006.01) |
| *F28D 1/053* | (2006.01) |

(52) U.S. Cl.

CPC ..... *F28F 9/0224* (2013.01); *F28D 1/05366* (2013.01); *F28F 2225/08* (2013.01)

(58) Field of Classification Search

USPC ..... 165/173, 151, 906, DIG. 906, 153

See application file for complete search history.

(56) References Cited

U.S. PATENT DOCUMENTS 4,582,127 A 4/1986 Moranne (Continued)

FOREIGN PATENT DOCUMENTS

| | | | |
|---|---|---|---|
| FR | 2720490 | A1 | 12/1995 |
| FR | 2745079 | A1 | 8/1997 |
| WO | WO 2005028990 | A1 | 3/2005 |

OTHER PUBLICATIONS

English language abstract for FR2720490 extracted from espacenet.com database, dated Jan. 27, 2009.

(Continued)

*Primary Examiner* — Khoa Huynh
*Assistant Examiner* — Timothy K Trieu
(74) *Attorney, Agent, or Firm* — Howard & Howard Attorneys PLLC

(57) ABSTRACT

The invention relates to a manifold, of the type comprising a substantially flat plate (20) with holes (22) to accept tubes of a heat exchanger, and turned-up lateral edges (24) extending at an angle to said plate (20) and connected thereto by at least one curved portion in which ribs (52) are formed, the ribs each having a convexity extending substantially in the direction of extension of the lateral edges (24). The plate (20) comprises at least one additional rib (50) between at least some of said holes (22), which ribs each have a convexity extending substantially in the opposite direction to the direction in which the lateral edges (24) extend.

18 Claims, 3 Drawing Sheets

(56) References Cited

U.S. PATENT DOCUMENTS

| | | | | |
|---|---|---|---|---|
| 5,178,211 | A * | 1/1993 | Bauer et al. | 165/153 |
| 5,492,172 | A * | 2/1996 | Laveran et al. | 165/173 |
| 5,816,316 | A * | 10/1998 | Hoffnung | 165/76 |
| 6,988,544 | B2 * | 1/2006 | Ozaki et al. | 165/173 |
| 2003/0217838 | A1 | 11/2003 | Dey et al. | |
| 2007/0000657 | A1 | 1/2007 | Emrich et al. | |

OTHER PUBLICATIONS

English language abstract for FR2745079 extracted from espacenet.com database, dated Jan. 27, 2009.

English language abstract for WO2005/028990 extracted from espacenet.com database, dated Jan. 27, 2009.

PCT International Search Report for PCT/EP2006/067960, dated Jan. 15, 2007, 3 pages.

* cited by examiner

REINFORCED COLLECTOR FOR THE COLLECTING BOX OF A HEAT EXCHANGER AND COLLECTING BOX COMPRISING ONE SUCH COLLECTOR

RELATED APPLICATIONS

This application claims priority to and all the advantages of International Patent Application No. PCT/EP2006/067960, filed on Oct. 31, 2006, which claims priority to French Application No. FR 0511181, filed on Nov. 2, 2005.

BACKGROUND OF THE INVENTION

The invention relates to the field of heat exchangers and deals more specifically with a manifold for a header tank, of the type comprising a substantially flat plate with openings to accept tubes of a heat exchanger, and turned-up lateral edges extending at an angle to said plate and connected thereto by at least one curved portion in which ribs are formed, the ribs each having a convexity extending substantially in the direction of extension of the lateral edges.

Manifolds such as this are used in particular in header tanks obtained by two-part manifold assembly, namely a manifold and a cover, the manifold usually being made of aluminum or aluminum-based alloy.

Header tanks such as this are used in heat exchangers and, in particular, in motor vehicle engine cooling radiators or radiators used as intercoolers. In such radiators, the coolant or the supercharging air flowing through the header tank and through the tubes is at a high pressure and at a temperature that may exceed 100° C. One of the chief difficulties when designing such header tanks is that of making the manifold suitably able to withstand pressure without using too great a thickness of material from which to make it.

Certain header tanks the design of which is aimed at solving this problem are already known, for example the one disclosed in US 2003 217838. In that document, the manifold has a substantially U-shaped cross section and its thickness is doubled by a fold of material where the branches of the U meet the bottom of this U. This type of design increases the amount of raw material used and occupies a great deal of space, and the fact that the manifold has to be brazed to itself at the folds prevents, among other things, the use of a corrosion-resistant coating within it.

FR 2 720 490 discloses a manifold plate that has openings in a substantially flat region that meets at least one curved region of cylindrical overall shape deviating from the plane of the flat region, in which the cylindrical shape is interrupted by a multitude of recessed zones. While it offers good yield strength, this type of manifold plate is nonetheless particularly ill-suited to the insertion of tubes.

The invention aims to improve the situation.

SUMMARY OF THE INVENTION

To that end, the invention proposes a manifold, of the type comprising a substantially flat plate with holes to accept tubes of a heat exchanger, and turned-up lateral edges extending at an angle to said plate and connected thereto by at least one curved portion in which ribs are formed, the ribs each having a convexity extending substantially in the direction of extension of the lateral edges, the plate further comprising additional ribs between at least some of said holes. Advantageously, the ribs of the plate each have a convexity extending substantially in the opposite direction to the direction in which the lateral edges extend.

In one embodiment, the ribs of the plate are positioned between each of the holes, and each hole is thus surrounded by two ribs the convexities of which form a guide for inserting a tube.

A manifold such as this is particularly attractive in that it offers good yield strength and ability to withstand pressure by virtue of the ribs produced, while at the same time offering the possibility of guiding the tubes in order to insert them.

In another embodiment, the lateral edges also have ribs, it being possible for the ribs of each lateral edge each to have a convexity extending in the directions of the opposite lateral edge. At least some of the ribs of the lateral edges may be positioned in the continuation of the ribs of the curved portion or, by contrast, may be positioned on the manifold in such a way that they alternate with the ribs of the curved portion. Advantageously, the ribs of the lateral edges extend over part of the lateral edges not including the end of these edges.

A manifold such as this is further strengthened by the presence of the ribs on the lateral edges. Positioning the ribs of the lateral edges in the continuation of or, on the other hand, alternating with, the ribs of the curved portion allows better control over the way in which the manifold deforms. Furthermore, positioning the convexity of the ribs toward the opposite lateral edge, that is to say toward the inside of the header tank when this tank is mounted, allows for a space saving. Finally, the limited extent of the ribs of the lateral edges means that a cover can be positioned inside the edges of the manifold, to which it can then be attached using known methods.

In one embodiment, the manifold has a substantially U-shaped cross section the branches of which U form the lateral edges. The manifold can also be made of aluminum or aluminum alloy.

The invention also relates to a header tank which comprises a manifold that has the features quoted hereinabove, and a cover to close the manifold.

In one embodiment, the manifold and the cover both have a substantially U-shaped cross section. The branches of this U form the respective lateral edges for the two pieces of manifold assembly, the cover being able to be brazed to at least a part of the lateral edges of the manifold, near the end of these edges.

BRIEF DESCRIPTION OF THE DRAWINGS

Other features and advantages of the invention will become better apparent from reading the following description given by way of non-limiting illustration and taken from examples based on the drawings in which.

DETAILED DESCRIPTION OF THE INVENTION

Figure 1:
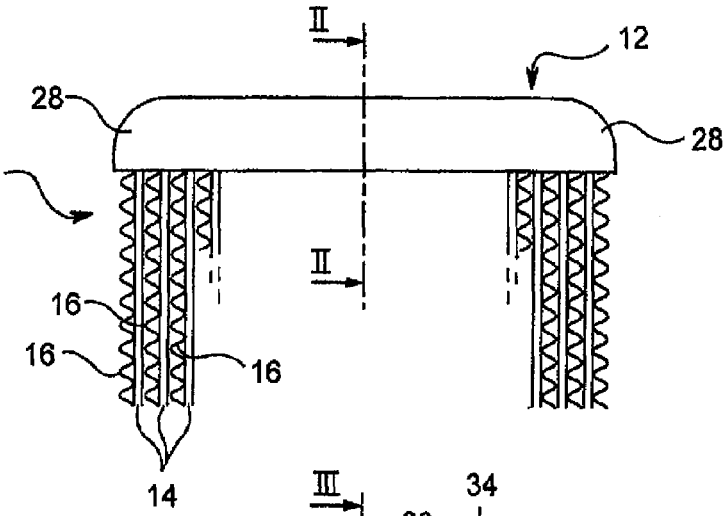
FIG. 1 is a partial side view of a heat exchanger comprising a header tank according to the invention.

Reference is made first of all to FIG. 1 which shows a heat exchanger 10 comprising a header tank 12 according to the invention, into which the ends of the tubes 14 of a heat exchanger bundle open. The tubes 14 are parallel flat tubes between which are positioned corrugated inserts 16 that form heat exchange fins. The heat exchanger 10 comprises an opposite header tank (not depicted) analogous to the header tank 12.

The exchanger 10 finds a particular application in motor vehicles and is designed to be produced by brazing in a single operation while at the same time offering good ability to withstand pressure and a high yield strength.

Figure 2:
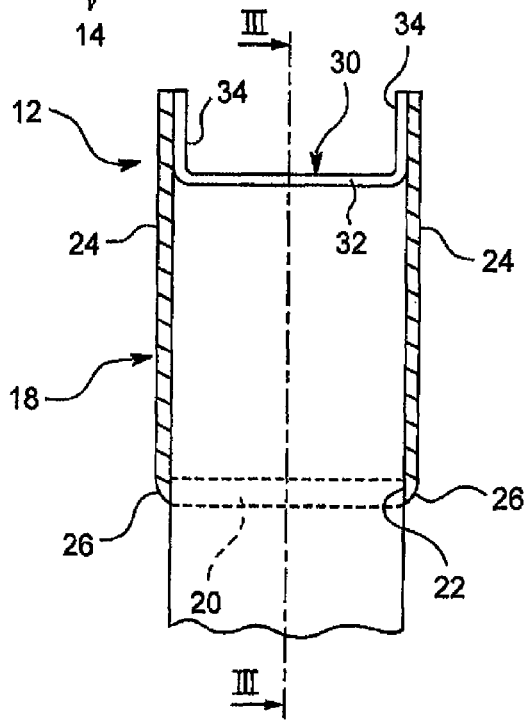
FIG. 2 is a view in section, on a larger scale, of the header tank on II-II of FIG. 1.

As can be seen in the sectioned view of FIG. 2, the header tank 12 is made up of two metal components nested one inside the other intended to be assembled by brazing. The header tank 12 comprises a manifold 18 produced in the form of a metal element (for example made of aluminum or an aluminum alloy) with a U-shaped profile having a bottom wall or plate 20 equipped with holes 22 for the insertion of tubes 14. The manifold also has two lateral walls or lateral edges 24 connected to the plate 20. The lateral walls 24 of the manifold 18 that form the two branches of the U are of identical heights, although it is possible for the height to vary relative to the bottom wall 20. The plate 20 is generally flat and the same is true of the lateral edges 24. These meet the plate 20 at an angle of about 90°. This angle could be different. The plate 20 is connected to the lateral edges 24 via curved portions 26.

Figure 3:
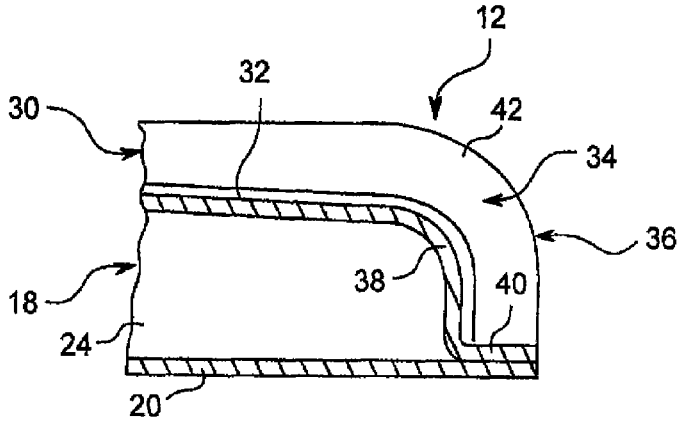
FIG. 3 is a view in part section on III-III of FIG. 2, taken at one end of the header tank.

As can be seen in FIG. 1 and also in FIG. 3, the lateral edges 24 have a variable height near the end of the manifold 18. In particular, the lateral edges 24 of the manifold have two curved portions 28 each of which extends as far as the plate 20.

The header tank 12 comprises another piece, namely a cover 30 made in the form of a metal element (for example of aluminum or an aluminum alloy) with a U-shaped profile having a bottom wall 32 extending in a plane parallel to the plane in which the plate 20 extends, and two lateral walls 34 connected to the bottom wall 32. The lateral edges 34 of the cover are generally flat and make an angle of about 90° with the bottom wall 32. As depicted in FIG. 2, the lateral walls 34 of the cover 30 that form the two branches of the U may be of identical heights.

The cover 30 is nested inside the manifold 18 in such a way that their respective U-shaped profiles face in the same direction, that is to say away from the tubes 14 of the heat exchanger bundle.

The result of this is that the lateral walls 34 of the cover 30 come into contact, via their outside, with part of the lateral edges 24 of the manifold 18, on the inside of the latter (FIG. 2).

The cover 30 further comprises two end regions 36 (FIG. 3) each of which is curved toward the plate 20 of the manifold 18. In each of these end portions, the bottom wall 32 of the cover has a curved portion 38 ending in a rim 40 capable of pressing against the plate 20 of the manifold 18. The rim 40 is itself connected to a bent part 42 of each lateral edge of the cover to close the header tank 12.

Large surface areas with good surface contact that are highly suitable for brazing can thus be brazed together. The manifold 18 is advantageously produced by bending a metal sheet such that it can be given a U-shaped profile, the holes 22 intended for the insertion of the tubes 14 preferably being produced in the metal component after bending.

The cover 30 for its part is advantageously produced by pressing, the end portions of the cover also being produced during this pressing operation.

Figure 4:
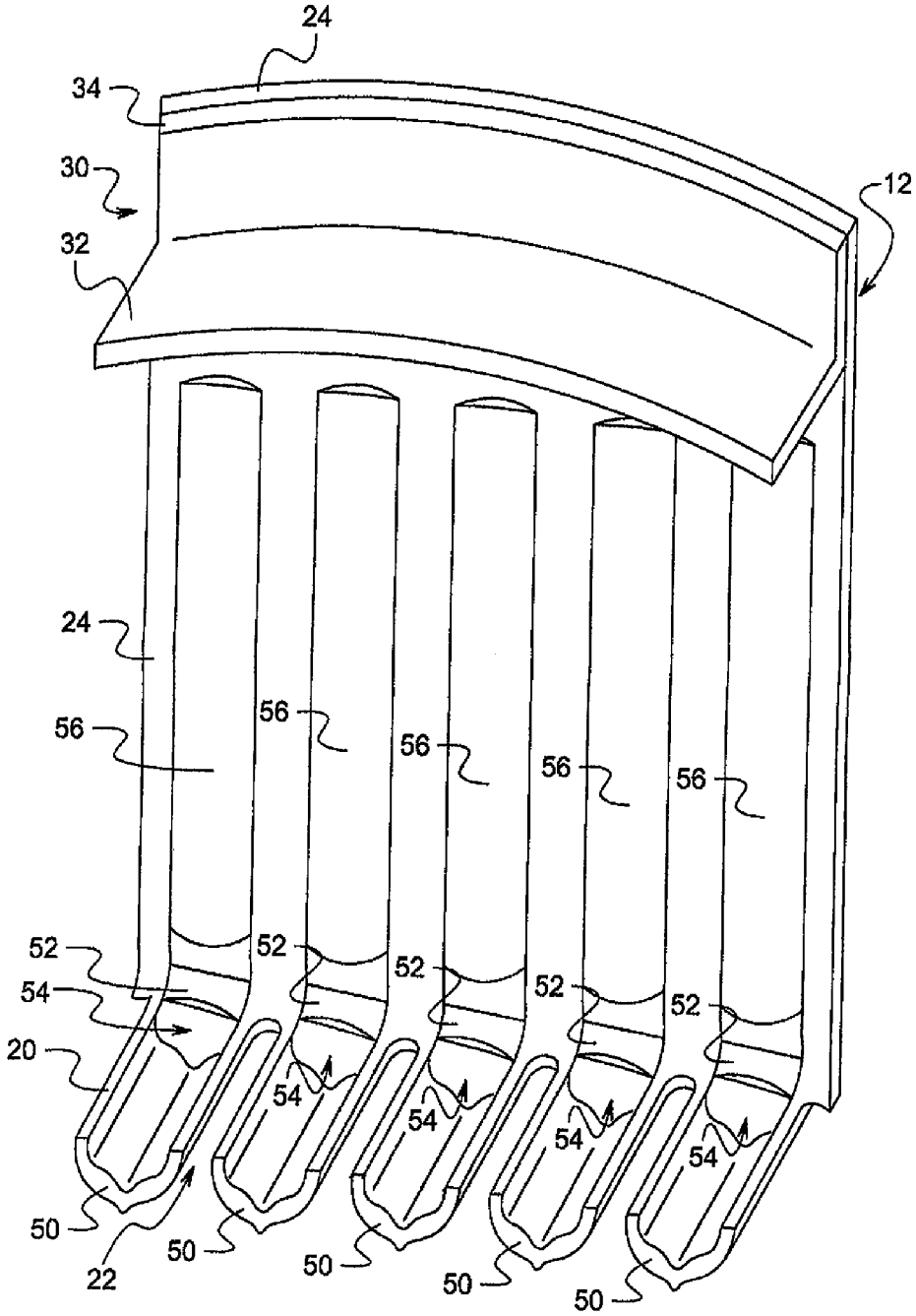
FIG. 4 is a partial perspective view showing the ribs of the manifold.

To strengthen this header tank, ribs are made in the manifold 18. FIG. 4 is a perspective part view of the header tank 12 providing a better illustration of how the ribs are distributed.

Prior to bending, the manifold 18 is pressed to form three distinct types of rib in the plate 20, the lateral edges 24 and the curved portions 26.

Ribs 50 are first of all produced between each of the holes 22. The ribs 50 extend over the entire width of the plate 20 between the curved portions 26 and the lateral edges 24. The ribs 50 thus extend uniformly over the length of the manifold 18.

The ribs 50 have a substantially V-shaped cross section and are produced toward the outside of the tank 12. The ribs 50 thus have a convexity extending substantially in the opposite direction to the direction in which the lateral edges extend.

The ribs 50 thus form projections surrounding the holes 22. Each pair of ribs 50 surrounding a given hole 22 forms a guide for the insertion of the tubes 14, each by way of one branch of the V of which it is formed.

Other types of cross section for the ribs 50 are conceivable, so as to allow even better insertion of the tubes 14 while at the same time providing the manifold 18 with optimum rigidity.

Ribs 52 are produced in the curved portions 26. Like the ribs 50, the ribs 52 extend in the direction of the width of the plate 20 and are each positioned facing a rib 50 in the continuation thereof.

The ribs 52 are produced toward the inside of the tank 12. The ribs 52 thus have a convexity extending substantially in the direction in which the lateral edges 24 extend. A region 54 allows each rib 50 to be connected to the rib 52 which is its continuation and which departs in substantially the opposite direction.

The ribs 52 allow for a substantial improvement in the ability to withstand pressure and in the yield strength. This aspect is all the more critical because, traditionally, the portions 26 have constituted significant weak points in header tanks of the type that the tank 12 represents.

Finally, ribs 56 are produced in the lateral edges 24. Like the ribs 50 and 52, the ribs 56 extend in the direction of the width of the plate 20 and are each positioned facing a rib 52, in the continuation thereof.

The ribs 56 are also produced toward the inside of the tank 12. The ribs 56 thus have a convexity extending substantially in the direction of the opposite lateral edge. The ribs 56 extend over most of the lateral edges 24, up to a chosen distance away from the end of the edges 24 that will allow the cover 30 to be housed and brazed into the manifold 18.

In the example described here, the ribs 50, 52 and 56 are not only in the continuation of one another but are also continuous. These ribs thus form a rib which extends over the entire width of the manifold 18, from a position close to the end of one lateral edge to another position close to the end of the opposite lateral edge, passing via the plate. Furthermore, while all the holes 22 depicted are flanked by ribs 50, 52 and 56, the invention does not exclude the situation whereby the holes 22 at the ends of the plate 20 are flanked by just one rib 50, 52 or 56, or none at all.

Figure 5:
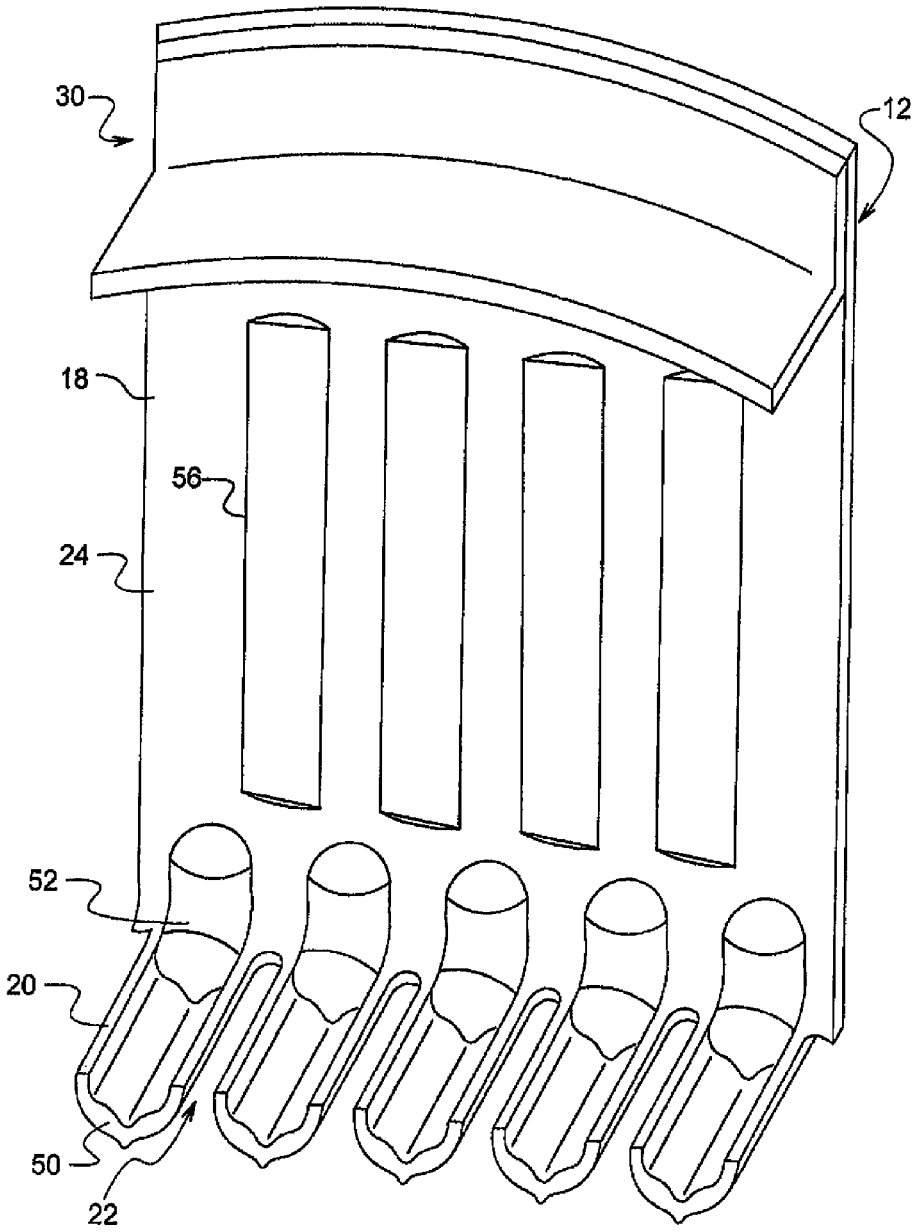
FIG. 5 is a partial perspective view of an alternative form of FIG. 4.

In another embodiment depicted in FIG. 5, the ribs 50 and 52 are unchanged in their constitution and layout. By contrast, the ribs 56 are offset, and each positioned facing a hole 22, that is to say such that they alternate with a rib 52.

The invention is not restricted to heat exchangers the header tanks of which are made of aluminum or aluminum alloy. It may in particular be applied to header tanks with the plate and the cover made of plastic, ribs then being produced for example at the groove in the manifold plate and between the holes that this comprises.

Furthermore, a person skilled in the art will be able to conceive of all the alternative forms that arise out of studying the claims that follow.

The invention claimed is:

1. A header tank comprising two metal components nested one inside the other and intended to be assembled by brazing, wherein the two metal components are a manifold (18) and a cover (30) to close the manifold (18), the manifold (18), comprising a substantially flat plate (20) with holes (22) to accept tubes (14) of a heat exchanger (10), and turned-up lateral edges (24) extending at an angle to the said plate (20) and connected thereto by at least one curved portion (26) in which a plurality of first ribs (52) are formed, the first ribs (52) each having a convexity extending substantially in the direction of extension of the lateral edges (24), characterized in that the plate (20) comprises at least one second rib (50) between at least some of the holes (22), wherein each at least one second rib (50) has a convexity extending substantially in the opposite direction to the direction in which the lateral edges (24) extend, and wherein the lateral edges (24) include a plurality of third ribs (56) that extend a chosen distance away from the end of the lateral edges (24), wherein the plurality of first ribs (52), the at least one second rib (50), and the plurality of third ribs (56) are distinct from one another, and wherein the plurality of first ribs (52) have a convexity extending opposite a convexity of the at least one second rib (50).

2. The header tank according to claim 1, characterized in that the at least one second rib (50) of the plate (20) are positioned between each of the holes (22), each of the holes (22) thus being surrounded by two second ribs (50), the convexities of which form a guide for inserting a tube (14).

3. The header tank according to claim 2, characterized in that the at least one second rib (50) of the plate (20) are positioned in the continuation of the plurality of first ribs (52) of the curved portion (26).

4. The header tank according to claim 1, characterized in that the plurality of third ribs (56) of each lateral edge (24) each have a convexity extending in the direction of the opposite lateral edge (24).

5. The header tank according to claim 4, characterized in that at least some of the plurality of third ribs (56) of the lateral edges (24) lie in the continuation of the at least one second rib (50) of the curved portion (26).

6. The header tank according to claim 4, characterized in that at least some of the plurality of third ribs (56) of the lateral edges (24) are positioned on the manifold (18) in such a way that they alternate with the plurality of first ribs (52) of the curved portion (26).

7. The header tank according to claim 1, characterized in that at least some of the plurality of third ribs (56) of the lateral edges (24) lie in the continuation of the at least one second rib (50) of the curved portion (26).

8. The header tank according to claim 1, characterized in that at least some of the plurality of third ribs (56) of the lateral edges (24) are positioned on the manifold (18) in such a way that they alternate with the plurality of first ribs (52) of the curved portion (26).

9. The header tank according to claim 1, characterized in that the at least one second rib (50) of the plate (20) is positioned in the continuation of the plurality of first ribs (52) of the curved portion (26) so that the plurality of first, at least one second, and plurality of third ribs (50, 52, 56) of the plate (20), of the curved region (26), and of the lateral edges (24) form a collection of ribs extending across the entire width of the manifold (18).

10. The header tank according to claim 1, characterized in that the at least one second rib (50) of the plate (20) is positioned in the continuation of the plurality of first ribs (52) of the curved portion (26).

11. The header tank according to claim 1, characterized in that it has a substantially U-shaped cross section, the branches of which U form the lateral edges (24).

12. The header tank according to claim 1, characterized in that the manifold (18) is made of aluminum or aluminum alloy.

13. The header tank according to claim 1, characterized in that the manifold (18) and the cover (30) both have a substantially U-shaped cross section, the branches of which U form the respective lateral edges (24, 34) and in that the cover can be brazed to at least a part of the lateral edges (24) of the manifold, near the end of these edges.

14. The header tank according to claim 1, characterized in that the manifold (18) and the cover (30) are made of aluminum or aluminum alloy.

15. The header tank according to claim 1, characterized in that the at least one second rib (50) of the plate (20) are positioned in the continuation of the plurality of first ribs (52) of the curved portion (26).

16. A heat exchanger comprising the header tank according to claim 1.

17. A manifold (18) comprising: a substantially flat plate (20) with holes (22) to accept tubes (14) of a heat exchanger (10), and turned-up lateral edges (24) extending at an angle to the plate (20) and connected thereto by at least one curved portion (26) in which a plurality of first ribs (52) are formed, the plurality of first ribs (52) each having a convexity extending substantially in the direction of extension of the lateral edges (24), characterized in that the plate (20) comprises at least one second rib (50) between at least some of the holes (22), wherein each at least one second rib (50) has a convexity extending substantially in the opposite direction to the direction in which the lateral edges (24) extend, wherein the lateral edges (24) include a plurality of third ribs (56) that extend a chosen distance away from the end of these edges (24) and wherein the plurality of third ribs (56) of each lateral edge (24) each have a convexity extending in the direction of the opposite lateral edge (24), and wherein the plurality of first ribs (52) have a convexity extending opposite a convexity of the at least one second rib (50).

18. A manifold (18) comprising: a substantially flat plate (20) with holes (22) to accept tubes (14) of a heat exchanger (10), and turned-up lateral edges (24) extending at an angle to the plate (20) and connected thereto by at least one curved portion (26) in which a plurality of first ribs (52) are formed, the plurality of first ribs (52) each having a convexity extending substantially in the direction of extension of the lateral edges (24), characterized in that the plate (20) comprises at least one second rib (50) between at least some of the holes (22), wherein each at least one second rib (50) has a convexity extending substantially in the opposite direction to the direction in which the lateral edges (24) extend and wherein a region (54) connects each of ribs (50) to each of plurality of first ribs (52), wherein the lateral edges (24) include a plurality of third ribs (56) that extend a chosen distance away from the end of these edges (24), and wherein the plurality of first ribs (52) have a convexity extending opposite a convexity of the at least one second rib (50).

* * * * *